US006182333B1

(12) United States Patent
Lauhus

(10) Patent No.: US 6,182,333 B1
(45) **Date of Patent: *Feb. 6, 2001**

(54) DRAFTING SYSTEM SPINNING ROLLER FOR PRODUCING THREAD

(75) Inventor: Werner P. Lauhus, Havixbeck (DE)

(73) Assignee: Day International, Inc., Dayton, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/029,745

(22) PCT Filed: Aug. 27, 1996

(86) PCT No.: PCT/EP96/03773

§ 371 Date: Mar. 2, 1998

§ 102(e) Date: Mar. 2, 1998

(87) PCT Pub. No.: WO97/08368

PCT Pub. Date: Sep. 18, 1997

(51) Int. Cl.[7] ..... D01H 5/74
(52) U.S. Cl. ..... 19/258; 19/236; 492/56
(58) Field of Search ..... 19/236, 251, 258, 19/259, 287; 57/315; 492/53, 56

(56) References Cited

U.S. PATENT DOCUMENTS

| | | | | |
|---|---|---|---|---|
| 2,570,935 | * | 10/1951 | Freelander | 19/258 |
| 2,843,883 | * | 7/1958 | Rockoff | 19/258 |
| 2,863,175 | * | 12/1958 | Meyer | 19/258 |
| 2,932,859 | * | 4/1960 | Rockoff | 19/258 |
| 3,381,350 | * | 5/1968 | Kemmler | 19/258 |
| 4,173,058 | * | 11/1979 | Stieger | 29/895.32 |
| 4,492,012 | * | 1/1985 | Pala et al. | 29/895.32 |
| 4,837,908 | * | 6/1989 | Beveridge, Jr. | 29/130 |
| 5,307,563 | * | 5/1994 | Svenka | 29/895.213 |
| 5,433,691 | * | 7/1995 | Hiraoka | 492/56 |
| 5,451,197 | * | 9/1995 | Grant | 492/16 |
| 5,553,381 | * | 9/1996 | Leheonen | 492/16 |

* cited by examiner

*Primary Examiner*—John J. Calvert
*Assistant Examiner*—Gary L. Welch
(74) *Attorney, Agent, or Firm*—Killworth, Gottman, Hagan & Schaeff, L.L.P.

(57) ABSTRACT

The spinning cylinder for drafting systems comprises a cylindrical roll body (1) forming a sliding bearing together with a sliding bearing bush (3) which is slid on and axially fixed. The sliding bearing bush (3) includes a cylindrical socket (4) made of tubular plastic material or plastic compound onto which an elastomeric covering (5) has been extruded.

14 Claims, 1 Drawing Sheet

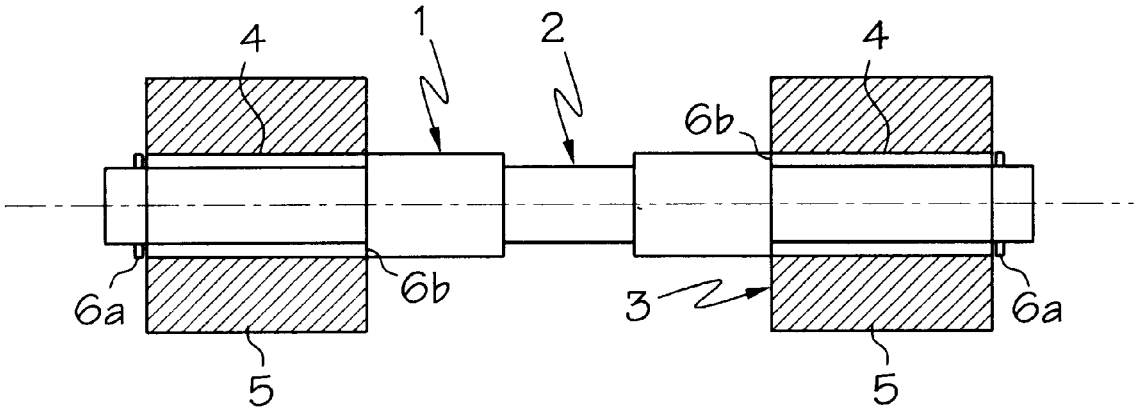
4
1
2
4
6b
6a
6b
3
6a
5
5

DRAFTING SYSTEM SPINNING ROLLER FOR PRODUCING THREAD

The invention relates to a spinning cylinder for drafting systems for use in the production of threads, said cylinder comprising a cylindrical roll body, an axially fixed cylindrical socket disposed on said roll body and forming a sliding bearing therewith, said socket being made of plastic material suitable for dry running conditions, and an elastomeric covering applied to the cylindrical socket.

In the DE-U-18 21 235 a spinning cylinder of that type is described as a press cylinder for drafting systems for which leather or rubber are indicated as the customary roller covering.

From the CH-A-513 995 a rubbing roller for spinning machines is further known in which a plastic socket is slid onto the roll body as a sliding bearing and is axially fixed, said plastic socket in turn bearing on the outside thereof a cylindrical roll made of steel. The plastic covering is obtained by injection moulding 60 weight percent of pulverized polytetra-fluorethylene, 10 weight percent of bronze particles and 20 weight percent of graphite at 360 to 370°C., so that the sliding bearing system consisting of the roll body and the plastic socket is self-lubricating.

With spinning cylinders mounted on ball bearings, it is further known to slip onto the outer ring of the bearing an aluminium socket and to either glue the elastomeric covering onto the outside thereof or to directly vulcanize it thereon, which is a labour-intensive process.

The problem underlying the invention is to modify the spinning cylinder of the above-mentioned type in such a way as to render its production extremely simple and inexpensive.

Starting out from the spinning cylinder of the above-mentioned type this problem is solved in that the plastic material forming the cylindrical socket consists of a high temperature resistant polymeric material and in that the elastomeric covering is directly applied to the cylindrical socket via extrusion, preferably via cross-head extrusion or injection moulding, or is bonded with it by vulcanization.

The cylindrical socket consists of a piece of tube made of high temperature resistant, covulcanizable polymeric material suitable for dry running conditions which is conveniently electrically conductive.

The threads to be produced using the spinning cylinder according to the invention include filaments as well as short or long staple fibers. Besides being adapted for use with drafting systems for ring spinning, the spinning cylinder can be applied in OE spinning, jet and airjet spinning, in special processes such as RingCan, Plyfil, Dref etc. and in spinning preparation, i.e. with combing machines, flyer and the like.

The plastic material or plastic compound, respectively, being utilized include thermoplastic materials based on polytetra-fluorethylene-homopolymerisate (PTFE), tetrafluorethyleneper-fluorpropylene-copolymerisate (FEP), polyetheretherketone (PEEK), polyimide, polyphenylensulfide (PPS) or blends thereof, respectively, in compound with e.g. molybdenum disulfide, graphite or bronze, which materials are filler or fiber reinforced.

The elastomeric covering preferably consists of a special compound based on an acrylonitrilebutadiene-copolymerisate (NBR rubber) having an acrylonitrile content ranging from 18 to 50%, of a partly or fully hydrogenated acrylonitrilebutadiene-copolymerlsate (H-NBR rubber), or of a carboxylated acrylonitrilebutadiene-terpolymerisate (X-NBR rubber) having a content of carboxylic groups ranging from 1 to 9%, or based on EPDM rubber.

The effort expended in production is further simplified by the possibility of co-extruding and co-vulcanizing the elastomeric covering simultaneously with the cylindrical socket in order to form the sliding bearing bush, a fixed bonding between the elastomeric covering and the cylindrical socket thus being established. Independent of the production of the roll bodies, this results in the manufacture of a run of tubing which is axially separated into pieces of tube at corresponding intervals, each of said pieces forming a sliding bearing bush comprising the inner cylindrical socket and the outer covering. Subsequent assembly is extremely simple as the sliding bearing bush thus obtained solely needs to be slipped onto the roll body with which it forms the sliding bearing and to be fixed axially.

Due to the configuration of the spinning cylinder according to the invention, the outer diameter of the elastomeric covering can be relatively small if this is permitted by the length of the fiber to be spun, or the wall thickness of the elastomeric covering can be enlarged substantially, which improves operational properties and increases the life of soft cots of <70 ShA in particular, since regrinding can be carried out more frequently.

The run-in phase common to ordinary plastic sliding bearings, which could affect the quality of the yarn to be produced, takes place during the final buffing of the elastomeric coverings on the shaft, which step precedes the process of yarn production.

The invention will be described in more detail by means of a drawing showing a schematical view in longitudinal section of an embodiment of a spinning cylinder.

The spinning cylinder illustrated in the drawing comprises a cylindrical roll body 1 having a central portion 2 for receiving a pendular arm not shown. A sliding bearing bush 3 is slipped onto said roll body 1 on each side of said central portion 2 and is axially fastened thereto. The sliding bearing bush 3 consists of a cylindrical socket 4 to which an elastomeric covering 5 is applied. The cylindrical socket 4 consists of a high temperature resistant polymer suitable for dry running conditions, which is bonded with the elastomeric covering 5 through vulcanization. The sliding bearing bushes 3 are axially fastened to the associated portions of the roll body 1 by means of a ring shoulder **6*a* and a protection ring 6*b* engaging in a circumferential groove, respectively. The ring shoulder 6*a* is to be provided having an outer diameter 1/10 mm smaller than the outer diameter of the respective cylindrical socket 4**.

What is claimed is:

1. A spinning cylinder for drafting systems for use in the production of threads, said cylinder comprising:

a cylindrical roll body, an axially fixed cylindrical socket disposed on said roll body and forming a sliding bearing therewith, said socket comprising a high temperature resistant polymeric material selected from the group consisting of polytetrafluoroethylene homopolymers, tetrafluoroethylene-perfluoropropylene copolymers, polyetherketones, polyimides, polyphenylene sulfides, and mixtures and blends thereof suitable for dry running conditions, and an extruded elastomeric covering vulcanized directly to said cylindrical socket.

2. A spinning cylinder as claimed in claim 1 wherein said elastomeric covering comprises a compound selected from the group consisting of: an acrylonitrile butadiene-copolymer (NBR rubber) having an acrylonitrile content in a range of 18 to 50%, a hydrogenated acrylonitrile butadiene-copolymerized (H-NBR rubber), and a carboxylated acrylonitrile butadiene-terpolymer (X-NBR rubber)

having a content of carboxylic groups ranging from 1 to 9%, and EPDM rubber.

3. A spinning cylinder as claimed in claim 1 wherein said high temperature resistant polymeric material is electrically conductive.

4. A spinning cylinder as claimed in claim 3 wherein said high temperature resistant polymeric material includes an electrically conductive material selected from the group consisting of molybdenum disulfide, graphite, or bronze.

5. A spinning cylinder as claimed in claim 1 wherein said elastomeric covering is directly applied to said cylindrical socket by cross-head extrusion.

6. A spinning cylinder as claimed in claim 1 wherein said elastomeric covering is directly applied to said cylindrical socket by injection molding.

7. A spinning cylinder as claimed in claim 1 wherein said cylindrical socket and said elastomeric covering are co-extruded together to form said sliding bearing.

8. A process for fabricating a spinning cylinder for use in drafting systems in the production of threads comprising:

providing a cylindrical roll body, providing a cylindrical socket comprising a high temperature resistant polymeric material selected from the group consisting of polytetrafluoroethylene homopolymers, tetrafluoroethylene-perfluoropropylene copolymers, polyetherketones, polyimides, polyphenylene sulfides, and mixtures and blends thereof suitable for dry running conditions, applying an elastomeric covering directly to said cylindrical socket by extruding said elastomeric covering over said cylindrical socket and joining said elastomeric covering and said cylindrical socket together by vulcanizing said socket and covering, and disposing said socket and covering on said roll body in an axially-fixed relationship to form a sliding bearing therewith.

9. A process as claimed in claim 8 wherein said elastomeric covering comprises a compound selected from the group consisting of: an acrylonitrile butadiene-copolymer (NBR rubber) having an acrylonitrile content in a range of 18 to 50%, a hydrogenated acrylonitrile butadiene-copolymerized (H-NBR rubber), and a carboxylated acrylonitrile butadiene-terpolymer (X-NBR rubber) having a content of carboxylic groups ranging from 1 to 9%, and EPDM rubber.

10. A process as claimed in claim 8 wherein said high temperature resistant polymeric material is electrically conductive.

11. A process as claimed in claim 10 wherein said high temperature resistant polymeric material includes an electrically conductive material selected from the group consisting of molybdenum disulfide, graphite, or bronze.

12. A process as claimed in claim 8 wherein said elastomeric covering is directly applied to said cylindrical socket by cross-head extrusion.

13. A process as claimed in claim 8 wherein said elastomeric covering is directly applied to said cylindrical socket by injection molding.

14. A process for fabricating a spinning cylinder for use in drafting systems in the production of threads comprising:

providing a cylindrical roll body, coextruding together a cylindrical socket and an elastomeric covering thereon, said cylindrical socket comprising a high temperature resistant polymeric material selected from the group consisting of polytetrafluoroethylene homopolymers, tetrafluoroethylene-perfluoropropylene copolymers, polyetherketones, polyimides, polyphenylene sulfides, and mixtures and blends thereof suitable for dry running conditions, joining said elastomeric covering and said cylindrical socket together by vulcanizing said socket and covering, and disposing said socket and covering on said roll body in an axially-fixed relationship to form a sliding bearing therewith.

* * * * *